US006591556B2

(12) United States Patent
Bertheaume et al.

(10) Patent No.: US 6,591,556 B2
(45) Date of Patent: Jul. 15, 2003

(54) SELF-CENTERING PIVOTAL CANOPY

(75) Inventors: Paul R. Bertheaume, Germantown, WI (US); Kenneth R. Bergmann, Greenfield, WI (US); Maurice Michaud, New Berlin, WI (US); Matt Dewey, Glendale, WI (US)

(73) Assignee: The Howard Company, Inc., Brookfield, WI (US)

( * ) Notice: Subject to any disclaimer, the term of this patent is extended or adjusted under 35 U.S.C. 154(b) by 0 days.

(21) Appl. No.: 09/766,178

(22) Filed: Jan. 19, 2001

(65) Prior Publication Data

US 2002/0096265 A1 Jul. 25, 2002

(51) Int. Cl.[7] ..... E04H 15/00

(52) U.S. Cl. ..... 52/74; 135/90; 135/87; 52/23; 52/90.1; 160/10; 160/46; 160/49; 160/56; 160/154; 160/313

(58) Field of Search ..... 135/87, 90; 52/23, 52/74, 90.1; 160/10, 46, 49, 56, 313, 154

(56) References Cited

U.S. PATENT DOCUMENTS

| | | | | |
|---|---|---|---|---|
| 1,007,306 | A | 10/1911 | Nevins et al. | |
| 2,840,848 | A | 7/1958 | Hickey | 16/154 |
| 3,044,540 | A | 7/1962 | Hammersley | 160/20 |
| 3,121,458 | A | 2/1964 | Blanchard | 160/58 |
| 4,945,606 | A | 8/1990 | Eckel | 163/313 |
| 4,951,351 | A | 8/1990 | Eckel | 16/254 |
| 5,390,719 | A | 2/1995 | Barnes | 160/10 |

*Primary Examiner*—Carl D. Friedman
*Assistant Examiner*—Christy Green
(74) *Attorney, Agent, or Firm*—Quarles & Brady LLP

(57) ABSTRACT

A canopy assembly for sheltering a drive-up ordering station of a fast food restaurant can pivot out of the way when impacted by a vehicle and return automatically to a centered position. A centering feature mounted to a column supporting a roof structure engages a pivotal coupler to bias the roof to a center position. This feature includes a pivot post assembly extending across the cavity and through a pair of helical slots in the coupler. When a leading end of the roof assembly is struck by a vehicle, the coupler is rotated and the pivot post engages the slots so that the coupler translates upward. The coupler is biased by gravity to a centered position in which the top ends of the slots rest on the pivot post.

20 Claims, 4 Drawing Sheets

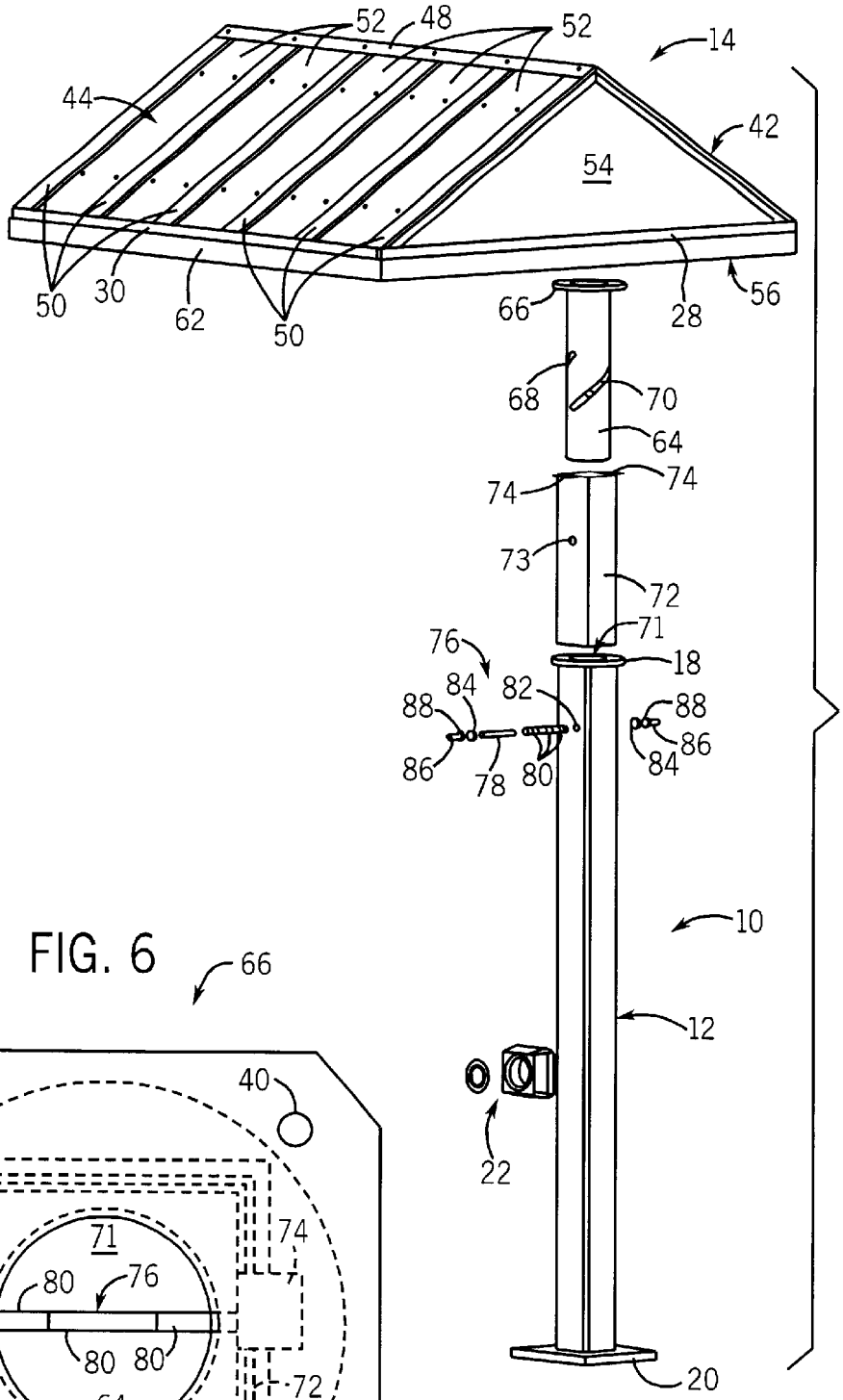
FIG. 5
FIG. 6
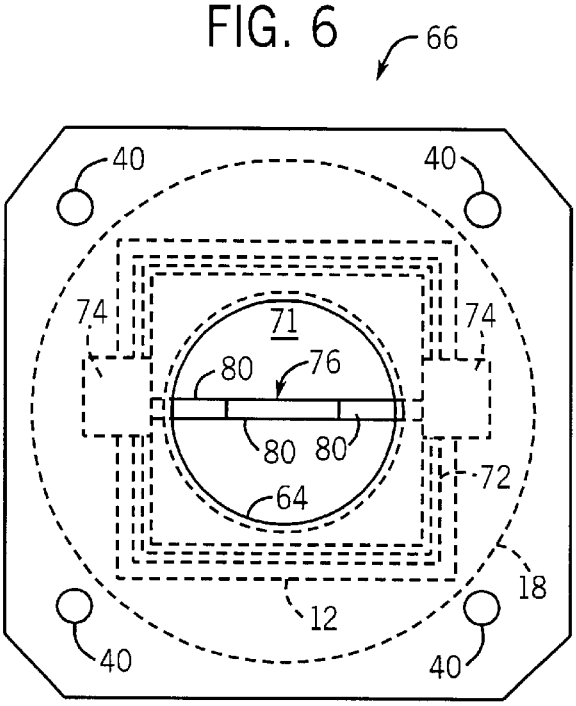

SELF-CENTERING PIVOTAL CANOPY

CROSS-REFERENCE TO RELATED APPLICATIONS

Not applicable.

STATEMENT OF FEDERALLY FUNDED RESEARCH/DEVELOPMENT

Not applicable.

BACKGROUND OF THE INVENTION

The invention relates to canopy structures, and in particular to damage-resistant canopies sheltering, for example, drive-up ordering stations of fast food restaurants.

It is well known to shelter from the weather particular areas, such as the drive-up ordering stations of fast food restaurants, with overhanging portions of a roof or a free-standing canopy structure. These structures are rigid and fixed in height. Consequently, they provide a prescribed maximum clearance for pedestrian or vehicular travel thereunder. The amount of clearance for roof overhangs usually depends on the height of the building to which it is attached. The height of the canopy may be selected to balance the competing interests of maximum clearance and adequate protection from the elements. That is, the canopy must not be too much higher than the subjects being sheltered, otherwise it may provide insufficient shelter because the weather elements (wind, rain, sleet, snow, etc.) may easily pass around the canopy. The size of the canopy structure is also selected with an eye to material and assembly costs. At the drive-up ordering station of a fast food restaurant, for example, a canopy with 100 inches of clearance may be selected to provide adequate shelter and still allow automobiles and many sizes of trucks to pass underneath.

It is possible for the canopy top to be struck by vehicles that are taller, or are carrying loads that are higher, than the maximum clearance. This can cause the canopy and the vehicle (or load) to be damaged. To overcome this problem, canopy structures have been designed with components that move or break-away when struck. For example, U.S. Pat. No. 5,390,710, incorporated herein by reference, discloses a canopy assembly having an upright post and a canopy top that can be pivoted about the post (and out of the way) by an overheight vehicle. The canopy top has an impact bar at a leading edge that when struck activates an alarm and travels a small distance. If the vehicle does not stop, the impact bar travels a further distance to release a latch and allow the canopy top to be swung by the vehicle out of the path of movement. While this device provides a damage-resistant canopy, it must be returned manually to the centered position after the vehicle has passed out of the way. Until the canopy top is repositioned, it will not shelter the desired area and it may be swung about the post by external forces, such as high wind, thus subjecting it (and nearby structures) to damage.

Accordingly, there exists a need for an improved canopy structure.

SUMMARY OF THE INVENTION

The present invention provides a self-centering pivotal canopy assembly overcoming the problems of the prior art. In particular, the canopy assembly includes a support column, at an upper end, a roof structure having a frame supporting one or more sheltering members. A coupler is attached to the column and the roof to allow the roof to be pivoted about the column in response to a moment force about the column. A centering element is mounted to the support column to engage the coupler and bias the roof to a center position such that the roof returns to the center position in the absence of the moment force.

In one form, the coupler includes a pair of identical helical slots. In the centered position, the top ends of the slots rest on the pivot post. The coupler can rotate through approximately 180 degrees until the pivot post contacts a bottom end of the helical slots. When the coupler is rotated, the pivot post engages the slots so that the coupler translates upward. Gravity biases the coupler to return to the centered position. Preferably, the pivot post assembly includes a cylindrical rod fixed to the support column and supporting a plurality of cylindrical glides that ride within the helical slots.

In another form, a plastic spacer sleeve is disposed in the cavity between the coupler. The support column, coupler and spacer sleeve have a pair of openings aligned to receive the pivot post. The spacer sleeve has a top end with at least one wing extending outwardly to engage the top end of the support column.

The roof can also include a rectangular, perforated bottom panel that is supported by a the lip of a skirt extending around the perimeter of the roof frame. A front section of the skirt can be pivoted away from the frame to allow the bottom panel to be slid out from the roof assembly for accessing lighting mounted underneath the sloping panels of the roof assembly.

In a preferred form, the present invention provides a canopy assembly for sheltering a drive-up ordering station of a fast food restaurant that can pivot out of the path of a vehicle impacting a leading end of a pivotal portion of the assembly. The canopy assembly includes a support column mounting a roof assembly at a coupler. The support column has an upper end defining a cavity in which is disposed a plastic spacer sleeve through which a pivot post assembly extends across the cavity. The pivot post assembly includes a cylindrical rod fixed to the support column and supporting a plurality of cylindrical glides which ride within a pair of helical slots in the tubular coupler, which is mounted to the frame of the roof assembly. When the coupler is rotated, the pivot post engages the slots so that the coupler translates upward so that the coupler is biased by gravity to a centered position in which the top ends of the slots engage the pivot post. The coupler can rotate through approximately 180 degrees in which the pivot post engages a bottom end of the helical slots.

Thus, the invention provides a canopy assembly having a roof assembly that can pivot when impacted by a vehicle that is taller than the maximum clearance height of the canopy assembly. After the vehicle is passed clear of the canopy, the pivotal roof assembly automatically returns to its initial centered position, without manual intervention being necessary.

These and other advantages of the invention will be apparent from the detailed description and drawings.

BRIEF DESCRIPTION OF THE DRAWINGS

FIG. 5 is an exploded assembly view of the canopy assembly;

FIG. 6 is a top view looking down on a pivot assembly and support column from line 6—6 of FIG. 2;

DETAILED DESCRIPTION OF THE PREFERRED EMBODIMENT

Figure 1:
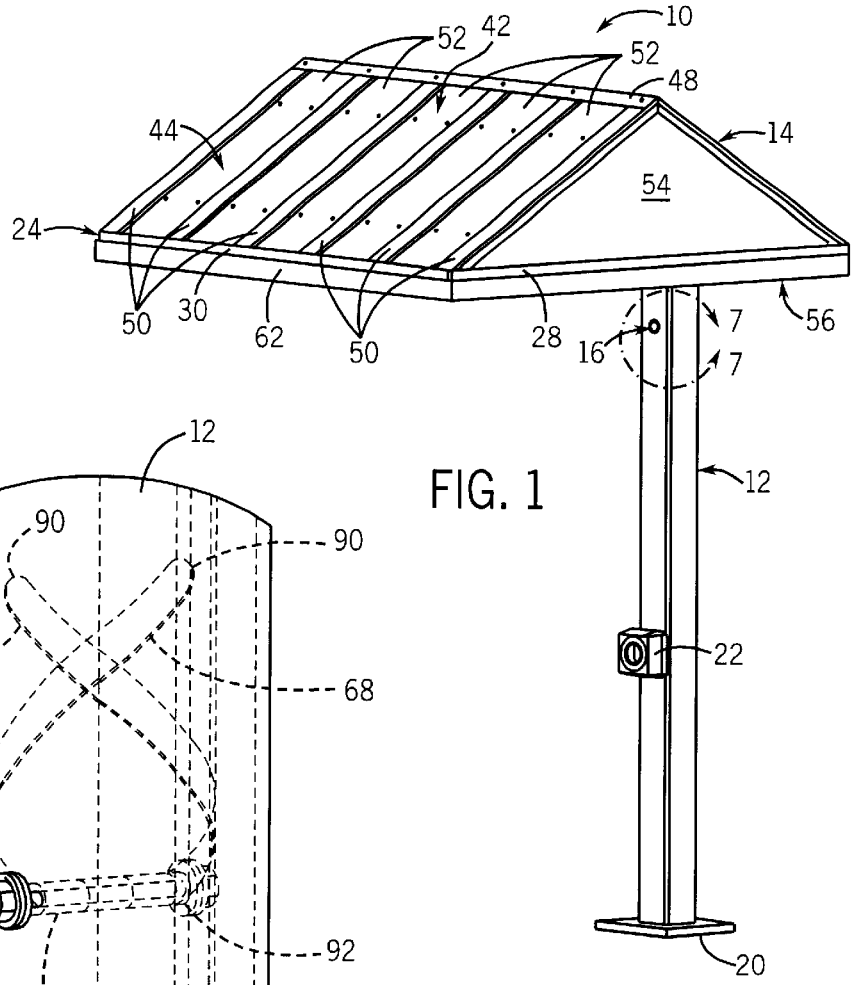
FIG. 1 is a perspective view of a self-centering pivotal canopy assembly of the present invention.

Although other applications are envisioned, the canopy assembly of the present invention is designed to shelter the drive-up, ordering station at a fast food restaurant. Referring to FIGS. 1–5, the canopy assembly 10 includes as primary components a support column 12 to which is mounted a roof assembly 14 at a pivot assembly 16. The canopy assembly 10 stands approximately 125 inches tall, with approximately 98 inches of clearance beneath the roof assembly 14, which is enough to allow automobiles and other passenger vehicles as well as many standard height commercial vehicles to pass thereunder. The canopy assembly 10 thus provides restaurant customers shelter from inclement weather, such as rain, sleet and snow, when ordering. As will be explained, the canopy assembly 10 is designed so that the roof assembly 14 will swing out of the way when impacted by an extra tall vehicle, thereby avoiding substantial damage to the vehicle and the canopy assembly 10.

The support column 12 is a square tubular member with a flanged top end 18 and a flanged bottom end 20 for anchoring the canopy assembly 10 to the ground by suitable bolts or anchors. When used to shelter the ordering station of a restaurant, a two-way communication device 22 with a speaker and microphone is mounted to the support column 12 at a suitable height from the ground to facilitate communication between a customer and the restaurant personnel.

The roof assembly 14 includes a rigid rectangular frame 24 with leading end 26 and trailing end 28 members joined together by a front 30 member and two shorter rear members 32 and 34. A center brace 36 is connected to the middle of the front member 30 and the inner ends of the rear members 32 and 34. The center brace 36 extends beyond the rear members 32 and 34 and a mounting plate 38 is attached at the intersection of the center brace 36 and the rear members 32 and 34. The mounting plate 38 includes four through bores (not shown) in which bolts are disposed for fastening the roof assembly 14 to the pivot assembly 16, described in detail below. The members of the frame 24 are preferably a stock, heavy-gauge, square tubular steel joined together by suitable weldment. Gussets (not shown) are used at the connection of the center brace 36 to the front member 30 and the rear members 32 and 34.

Figure 9:
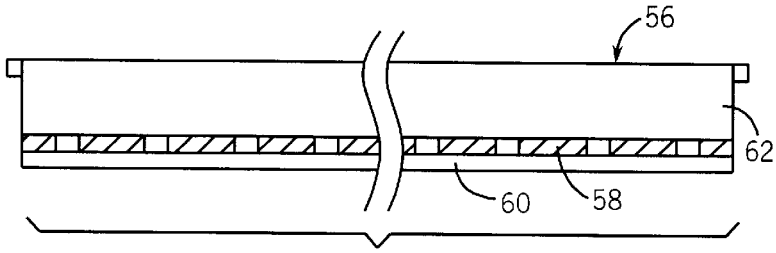
FIG. 9 is a rear view of a pivotal front skirt section, showing a perforated bottom panel in cross-section.
Figure 4:
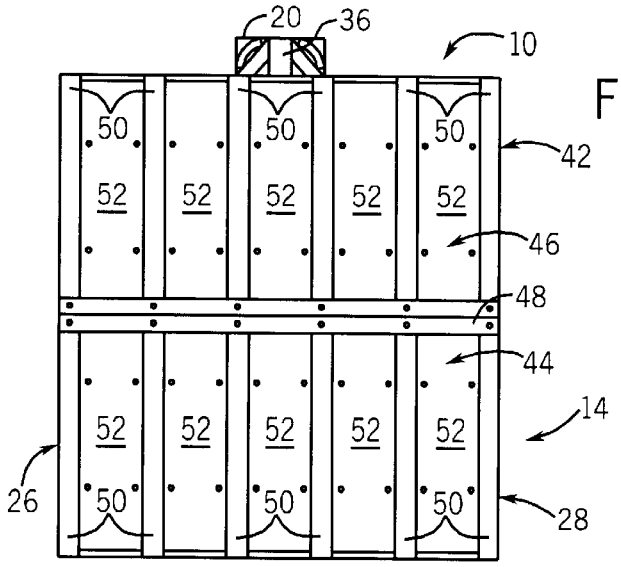
FIG. 4 is a top view of the canopy assembly.
Figure 3:
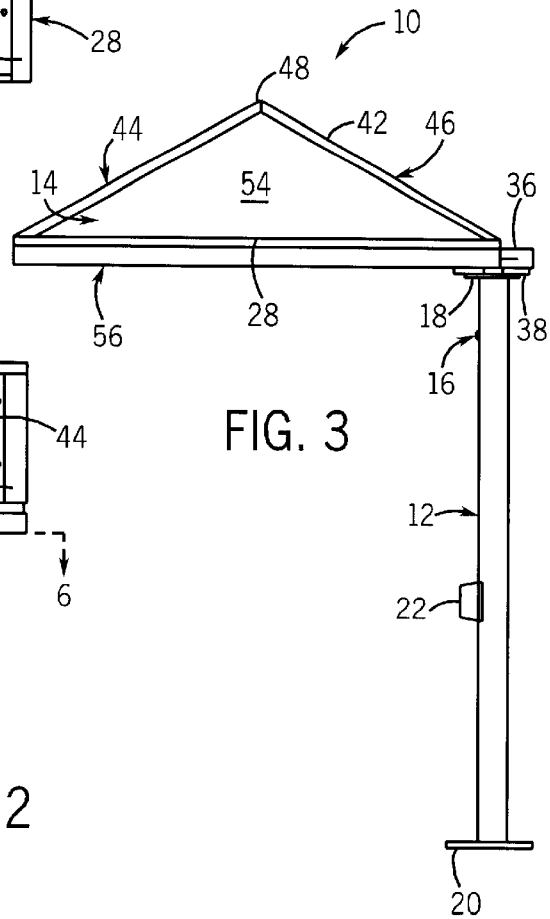
FIG. 3 is a right side view of the canopy assembly.
Figure 2:
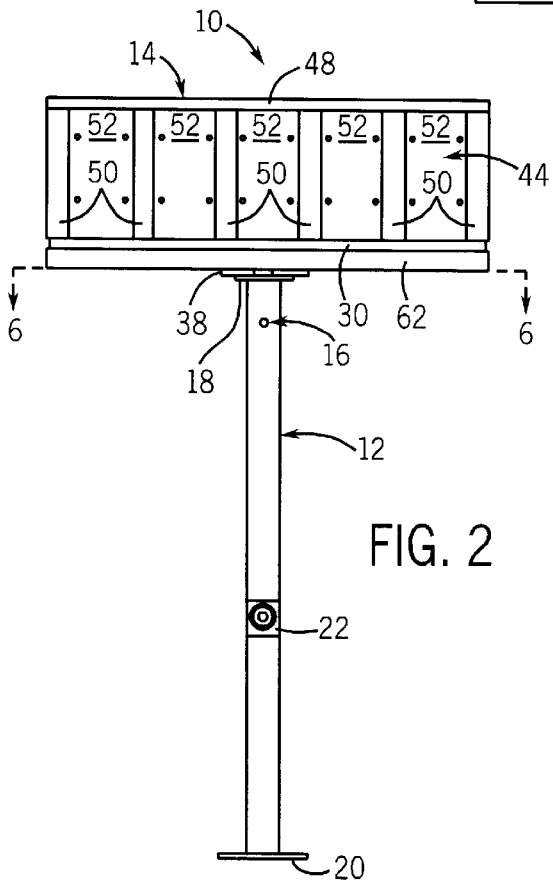
FIG. 2 is a front view of the canopy assembly.

The frame 24 supports a canopy 42 having any suitable configuration, but preferably having sloped front 44 and rear 46 sides joined together at a top ridgeline peak 48 and to the front 30 and rear 32, 34 members, respectively. The sides 44, 46 are preferably formed of aluminum stiles 50 with panels 52 fastened therebetween. Two triangular end panels 54 cap the leading 26 and trailing 28 ends. A skirt 56 extends around, and slightly below, the front 30, rear 32, 34 and end 26, 28 members of the frame 24 to support a bottom panel 50, (see FIG. 9) which is preferably perforated metal sheet. Referring to FIG. 9, the skirt 56 has an L-shaped cross-section and defines a lip or ledge 60 for supporting the perimeter of the bottom panel 58. A front section 62 of the skirt 56 can pivot away from he frame 24 to allow the bottom panel 58 to be slid out for accessing suitable lamps (not shown) mounted within the roof assembly 14 beneath the canopy 42.

Figure 7:
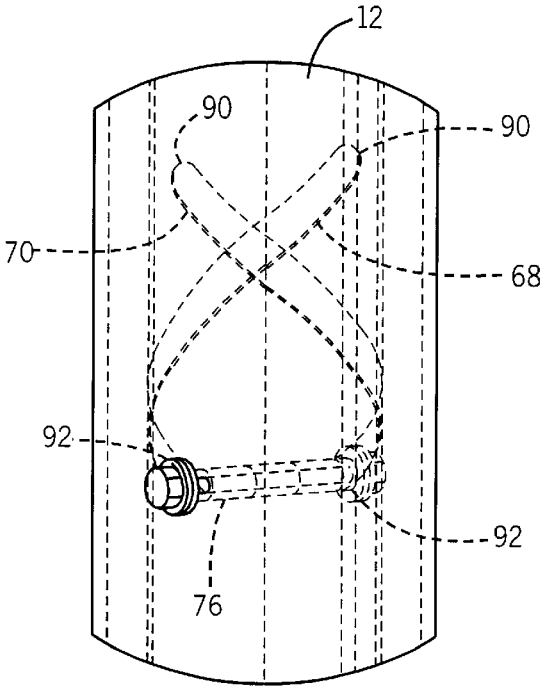
FIG. 7 is a cut out view taken along arc 7—7 of FIG. 1, showing a glide bar in a pair of helical slots.

Referring to FIGS. 5, 6 and 7, the pivot assembly 16 includes a cylindrical coupler or pivot tube 64 having a top end flange 66 an a pair of opposing helical slots 68 and 70. The top end flange 66 includes four bores 40 for bolts (not shown) used to secure the pivot tube 64 to the mounting plate 38 of the roof assembly 14. The helical slots 68 and 70 are preferably cut through the pivot tube 64 using a laser cutting machine at opposite portions of the pivot tube 64 (a shown in FIGS. 5 and 7). The slots 68 and 70 allow the roof assembly 14 to pivot through approximately 180 degrees in the counter-clockwise direction. Preferably, the pivot tube 64 is disposed within a spacer sleeve 72 having a square crosssection and made of a self-lubricating material, such as polyethylene. The spacer sleeve 72 fits within the hollow, square cavity 71 defined by the upper end of the support column 12 and is molded to include a pair of wings 74 that rest on the top end flange 18 of the support column. The sleeve 72, pivot tube 64 and support column 12 are coupled together by a stationary post assembly 76, which with the helical slots 68 and 70 make up the centering element of the canopy. The post assembly 76, wings 74 and the square walls of the sleeve 72 prevent the sleeve 72 from rotating or moving within the support column 12 and allow the pivot tube 64 to rotate and translate within the sleeve 72.

Referring to FIGS. 5, 6 and 7, the post assembly 76 includes a cylindrical rod 78 with a smooth outer diameter and a threaded inner diameter at its ends. About the rod 78 fit three cylindrical glides 80 made of a suitable self-lubricating material. The rod 78 is sized to fit through openings or bores 82 in the support column 12 and bores 73 in the pacer sleeve 72 SO that the two outer glides ride within the helical slots 68 and 70 of the pivot tube 64. A pair of bushings fit 84 within the bores 82 in the support column 1 and allow the rod 78 to rotate as needed. The rod 78 is secured to the support column 12 by threaded fasteners 86. The bushings 84 and washers 88 disposed about the rod 78 prevent the threaded fasteners 86 from inhibiting rotation of the rod 78 when the fasteners 86 are tightened.

Figure 8C:
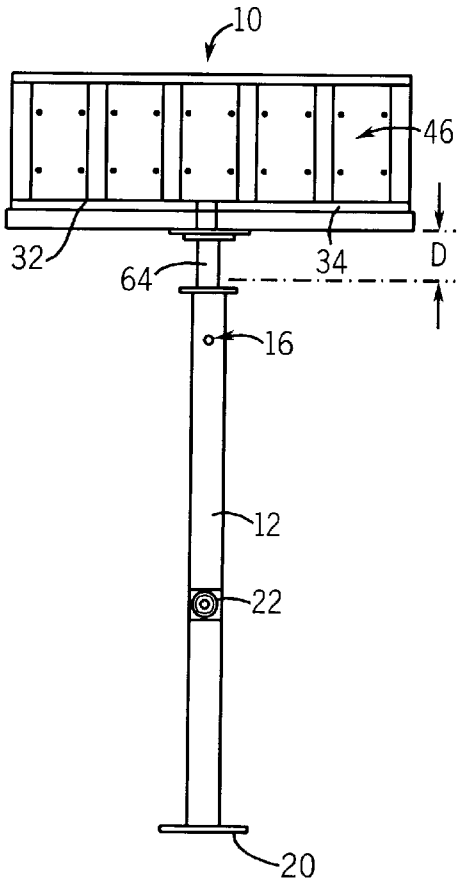
FIG. 8C shows the canopy assembly with the roof assembly pivoted 180 degrees.
Figure 8B:
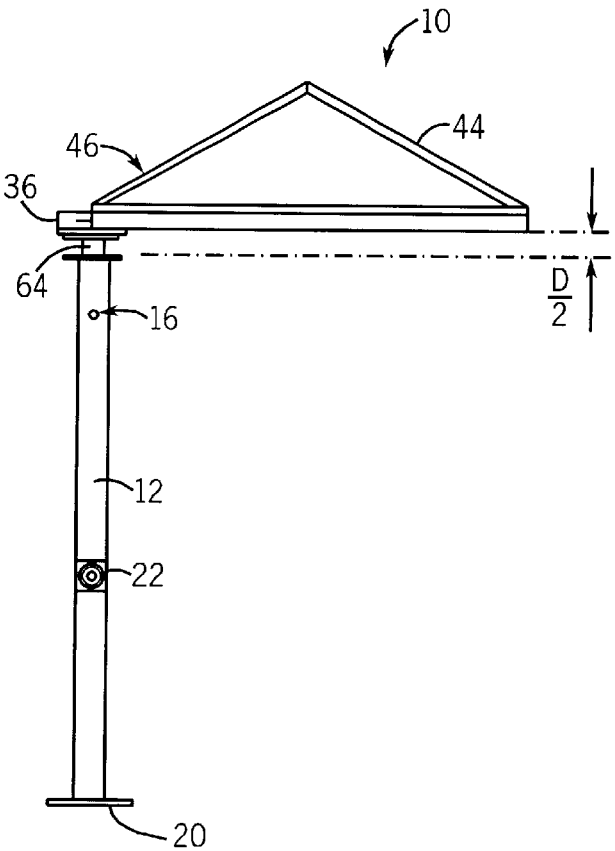
FIG. 8B shows the canopy assembly with the roof assembly pivoted 90 degrees.
Figure 8A:
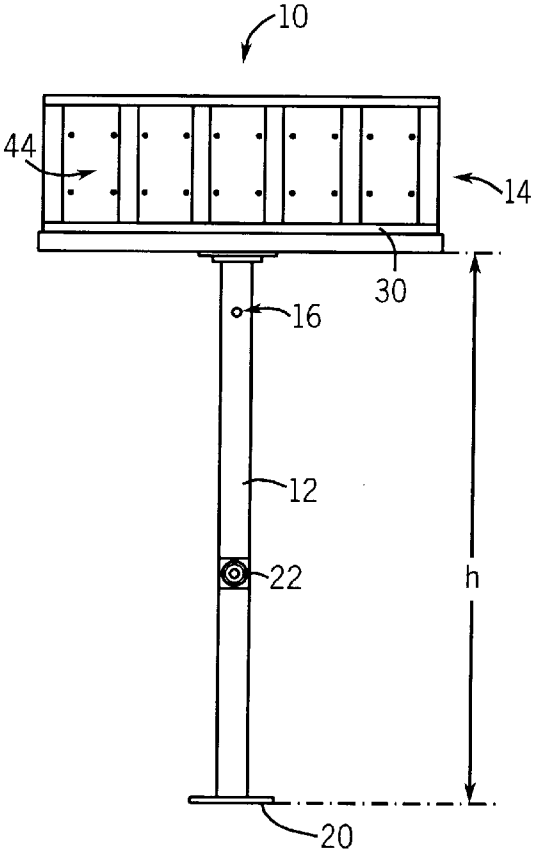
FIG. 8A shows the canopy assembly with the roof assembly centered.

In use, the canopy assembly 10 is ordinarily in the position shown by FIG. 8A. In this position, the roof assembly 14 is centered, that is oriented so that the front member 30 faces front, i.e., the side with the communication device 22, so as to provide a ceiling for the ordering area and thereby shelter persons from rain, snow, etc. when ordering. The bottom of the roof assembly 14 rests at a clearance height (h) above the ground. In this position, the pivot tube 64 rests on the post assembly 76 at top ends 90 of the helical 68 and 70 slots, as shown in FIG. 7. As such, the roof assembly can pivot in only one direction, namely, counter-clockwise. This direction is chosen because typically vehicles will be approaching the canopy assembly 10 from the leading end 26 because vehicle operators in the United States are seated on the left-hand side of the vehicles. In the event that the vehicle is too tall to fit under the roof assembly 14, the vehicle will contact the leading end 26 and create a moment, or rotational force, on the roof assembly 14 and, in turn, the pivot tube 64. Since the post assembly 76 is fixed in position, it will contact the slots 68 and 70 and force the pivot tube 64 to travel upward as it rotates.

When the roof assembly 14 has pivoted 90 degrees, as shown in FIG. 8B, it will be raised upward (D/2), which is roughly one-half the total travel distance (D) allowed. In this position, the post assembly 76 is approximately in the meddle of helical slots 68 and 70. The pivot tube 64 and roof assembly 14 will continue to rotate while the counter-clockwise rotational force is applied, i.e., while in contact with the vehicle, until the post assembly 76 contacts bottom ends 92 of the slots 68 and 70. In this position, as shown in FIG. 8C, the pivot tube 64 and roof assembly 14 will have rotated through 180 degrees and traveled upward the total travel distance (D), roughly 6–8 inches. By rotating 180 degrees, the roof assembly 14 is capable of swinging completely clear of the vehicle to prevent or reduce damage to the vehicle and the canopy assembly 10.

Once the vehicle has passed by the canopy assembly 10 so that a rotational force is no longer acting on the roof assembly 14, the weight of the roof assembly 14 will apply a downward force on the pivot tube 64. The pivot tube 64 will then be rotated clockwise and travel downward until the top ends 90 of the slots 68 and 70 contact and rest on the post assembly 76. Thus, the roof assembly 14 returns automatically to the initial, centered position.

A preferred embodiment of the invention has been described in considerable detail. Many modifications and variations to the preferred embodiment will be apparent to those skilled in the art, which will be within the spirit and scope of the invention. Therefore, the invention should not be limited to the described embodiment, rather the following claims should be referenced.

What is claimed is:

1. A self-centering pivotal canopy assembly, comprising:

a roof structure having a frame supporting one or more sheltering members;

a support column;

a centering element mounted to the support column; and a coupler attached to the roof and pivotally mounted to the support column, the coupler engaging the centering element when pivoted so as to return to a centered position when not pivoted.

2. The canopy of claim 1, wherein the coupler is fixed with respect to the roof and pivotally disposed in a cavity defined by the upper end of the support column.

3. The canopy of claim 2, wherein the coupler has at least one arcuate slot therethrough.

4. The canopy of claim 3, wherein the centering element slidably engages the slot when the coupler is pivoted so that the coupler translates upward.

5. The canopy of claim 4, wherein the centering element is a pivot post extending across the cavity.

6. A self-centering pivotal canopy assembly, comprising:

a roof structure having a frame supporting one or more sheltering members;

a support column;

a coupler attached to the support column and the roof so that the roof can be pivoted about the support column in response to a moment force about the support column; and a centering element mounted to the support column to engage the coupler so as to allow rotation of the coupler with respect to the support column and bias the roof to a center position such that the roof returns to the center position in the absence of the moment force;

wherein the coupler is fixed with respect to the roof and pivotally disposed in a cavity defined by the upper end of the support column;

wherein the coupler has at least one arcuate slot therethrough;

wherein the centering element slidably engages the slot when the coupler is pivoted so that the coupler translates upward;

wherein the centering element is a pivot post extending across the cavity;

wherein the coupler is tubular and has a pair of identical helical slots through opposite portions of the coupler and wherein the pivot post can slide between opposite ends of the slots when pivoted.

7. The canopy of claim 6, wherein the pivot post engages a top end of the slots when in the centered position.

8. The canopy of claim 7, wherein the coupler can rotate through approximately 180 degrees before the pivot post engages a bottom end of the slots.

9. A self-centering pivotal canopy assembly, comprising:

a roof structure having a frame supporting one or more sheltering members;

a support column;

a coupler attached to the support column and the roof so that the roof can be pivoted about the support column in response to a moment force about the support column; and a centering element mounted to the support column to engage the coupler so as to allow rotation of the coupler with respect to the support column and bias the roof to a center position such that the roof returns to the center position in the absence of the moment force;

wherein the coupler is fixed with respect to the roof and pivotally disposed in a cavity defined by the upper end of the support column;

wherein the coupler has at least one arcuate slot therethrough;

wherein the centering element slidably engages the slot when the couple is pivoted so that the coupler translates upward;

wherein the centering element is a pivot post extending across the cavity;

wherein the pivot post is a post assembly including a cylindrical rod supporting at least one glide made of a self-lubricating material.

10. The canopy of claim 9, wherein the top of the coupler has a flange mounted to the roof frame and sized larger than the cavity.

11. The canopy of claim 5, further including a spacer sleeve disposed within the cavity between the support column and the coupler, the spacer sleeve having a pair of openings aligned to receive the pivot post.

12. The canopy of claim 11, wherein the spacer sleeve has a top end with at least one wing extending outwardly to engage the upper end of the support column.

13. A self-centering pivotal canopy assembly, comprising:

a roof structure having a frame supporting one or more sheltering members;

a support column;

a coupler attached to the support column and the roof so that the roof can be pivoted about the support column in response to a moment force about the support column; and a centering element mounted to the support column to engage the coupler so as to allow rotation of the coupler with respect to the support column and bias the roof to a center position such that the roof returns to the center position in the absence of the moment force;

wherein the coupler is fixed with respect to the roof and pivotally disposed in a cavity defined by the upper end of the support column;

wherein the coupler has at least one arcuate slot therethrough;

wherein the centering element slidably engages the slot when the couple is pivoted so that the coupler translates upward;

wherein the centering element is a pivot post extending across the cavity;

further including a spacer sleeve disposed within the cavity between the support column and the coupler, the spacer sleeve having a pair of openings aligned to receive the pivot post.

wherein the spacer sleeve has a top end with at least one wing extending outwardly to engage the upper end of the support column;

wherein the spacer sleeve is made of a self-lubricating material.

14. The canopy of claim 10, wherein the roof further includes a plurality of stiles and panels forming a pair of upwardly sloping sides and a perforated panel disposed between the sloping sides.

15. The canopy of claim 14, wherein the roof further includes a skirt extending around the perimeter of the frame and having a lip for supporting the bottom panel and a section that can be pivoted away from the frame to facilitate removal of the bottom panel.

16. A canopy assembly for sheltering a drive-up ordering station of a fast food restaurant that can pivot out of the path of a vehicle impacting a leading end of a pivotal portion of the canopy assembly, the canopy assembly comprising:

a support column having an upper end defining a cavity;

a plastic space sleeve disposed within the cavity and having a top end wit a pair of wings extending outwardly to engage a top end of the support column;

a pivot post assembly including a cylindrical rod supporting at least one glide and fixed to the support column to extend through the spacer sleeve across the cavity;

a tubular coupler disposed within the spacer sleeve and having a pair of helical slots through which the pivot post is disposed so hat the coupler can rotate with respect to the support column, when rotated the pivot post engages the slot so hat the coupler translates upward; and a roof assembly having a rigid frame mounted to a top of the coupler, wherein the roof assembly is biased by the coupler to a centered position in which the pivot post engages a top end of the helical slots.

17. The canopy of claim 16, wherein the coupler can rotate through approximately 180 degrees wherein the pivot post engages a bottom end of the helical slots.

18. The canopy of claim 17, wherein the frame includes rigid members forming a rectangle and the canopy includes a plurality of stiles and panels.

19. The canopy of claim 18, wherein the roof assembly further includes a perforated bottom panel.

20. The canopy of claim 19, wherein the roof assembly further includes a skirt extending around the perimeter of the roof frame and having a lip for supporting the bottom panel, the skirt also having a section that can be pivoted away from the frame to facilitate removal of the bottom panel.

* * * * *

UNITED STATES PATENT AND TRADEMARK OFFICE

CERTIFICATE OF CORRECTION

PATENT NO. : 6,591,556 B2
DATED : July 15, 2003
INVENTOR(S) : Paul R. Bertheaume et al.

It is certified that error appears in the above-identified patent and that said Letters Patent is hereby corrected as shown below:

Column 4,
Line 2, "preferably perforated" should be -- preferably a perforated --.
Line 6, "from he frame" should be -- from the frame --.
Line 12, "66 an a" should be -- 66 and a --.
Line 17, "(a" should be -- (as --
Line 39, "pacer" should be -- spacer --.
Line 39, "SO" should be -- so --.

Column 6,
Line 37, "couple" should be -- coupler --.

Column 7,
Line 7, "couple" should be -- coupler --.

Column 8,
Line 2, "space" should be -- spacer --.
Line 3, "wit" should be -- with --.
Lines 10 and 12, "hat" should be -- that --.

Signed and Sealed this

Thirtieth Day of September, 2003

JAMES E. ROGAN
*Director of the United States Patent and Trademark Office*